US005229533A

United States Patent [19]

Sakurai

[11] Patent Number: 5,229,533

[45] Date of Patent: Jul. 20, 1993

[54] ELECTRONIC MUSICAL INSTRUMENT FOR STORING MUSICAL PLAY DATA HAVING MULTIPLE TONE COLORS

[75] Inventor: Yasushi Sakurai, Hamamatsu, Japan

[73] Assignee: Yamaha Corporation, Hamamatsu, Japan

[21] Appl. No.: 818,044

[22] Filed: Jan. 8, 1992

[30] Foreign Application Priority Data

Jan. 11, 1991 [JP] Japan ..... 3-002129

[51] Int. Cl.[5] ..... G10H 1/06; G10H 1/22; G10H 1/46

[52] U.S. Cl. ..... 84/618; 84/622; 84/633

[58] Field of Search ..... 84/609-614, 84/622-625, 633, 634-643, 618, DIG. 2, DIG. 12, DIG. 22, DIG. 29

[56] References Cited

U.S. PATENT DOCUMENTS 3,781,452 12/1973 Vauclain ..... 84/DIG. 29
3,885,110 5/1975 Di Matteo ..... 84/639 X
4,018,448 4/1977 Di Matteo ..... 84/639 X
4,930,390 6/1990 Kellogg et al. ..... 84/622 X
4,984,497 1/1991 Inagaki et al. ..... 84/622 X

*Primary Examiner*—Stanley J. Witkowski
*Attorney, Agent, or Firm*—Graham & James

[57] ABSTRACT

An instrument for storing musical playing data includes tone color assignment switch for assigning each of the designated tone colors to each of the recording tracks and record control device for recording the musical playing data into the recording tracks simultaneously with the assigned tone color thereto (DUAL mode). Also the record control device can be a device for recording the musical playing data into the recording track, with the assigned tone color thereto, to which the tone range, for example the left side tone range or the right side tone range of a keyboard, including the tone pitch of the musical playing data is preliminarily assigned (SPLIT mode). As a plurality of recording tracks are used in recording with the both modes, it allows a player to edit the data easily.

13 Claims, 10 Drawing Sheets

SEQUENCE DATA

| TRACK | 1 | 2 | ------- | 8 |
|---|---|---|---|---|
| | TONE COLOR | TONE COLOR | | TONE COLOR |
| | VOLUME | VOLUME | | VOLUME |
| | NOTE DATA | NOTE DATA | | NOTE DATA |
| | NOTE DATA | | | VOLUME |
| | ⋮ | ⋮ | ------- | ⋮ |
| | BAR | | | |
| | NOTE DATA | | | |
| | ⋮ | | | |
| | END DATA | END DATA | | END DATA |

Fig. 3

| | |
|---|---|
| TCMODE | TONE COLOR MODE FLAG |
| ORCH 1 | TONE COLOR #1 REGISTER |
| ORCH 2 | TONE COLOR #2 REGISTER |
| TC | TEMPO CLOCK |
| REC | RECORD FLAG (FOR EACH TRACK) |
| PLAY | PLAYBACK FLAG FOR EACH TRACK) |
| SEQ | SEQUENCE MODE FLAG |
| SEQPLAY | SEQUENCE PLAY FLAG |
| EDIT | EDIT MODE FLAG |

Fig. 10

ELECTRONIC MUSICAL INSTRUMENT FOR STORING MUSICAL PLAY DATA HAVING MULTIPLE TONE COLORS

BACKGROUND OF THE INVENTION

1. Field of the Invention

The present invention relates to an instrument for storing musical playing data and, more particularly, to an instrument for storing musical playing data in time series.

2. Description of the Prior Art

Sequencers for storing musical playing data in time series have been provided to players. The sequencers, generally, are capable of writing playing musical data into a track in the order of generation and reading it from the beginning of the track to play back the music.

Some musical instrument including the above sequencer has a special tone generation mode, such as a dual mode or a split mode. The dual mode is a mode in which one musical playing data is generated with two tone colors, while the split mode is a mode in which a range is divided into two or more ranges each of which has a different assignable tone color thereby to generate the tone with the assigned tone color.

In the above mentioned conventional musical instrument, when the dual mode or the split mode is designated as a tone generation mode, the mode designation data is written into a track, and after that the other musical playing data is successively written into the same track.

However, the both modes use only one track so that there is a limitation of editing of musical playing data for each tone color, that is, in the dual mode, change of sequence data with only one side tone color in a specified sequence area is almost impossible, and in the split mode, switching of tone generation and tone damp of sequence data with only one side tone color in a specified sequence area is also almost impossible.

SUMMARY OF THE INVENTION

It is therefore an object of the present invention to provide an instrument for storing musical playing data being capable of solving the above mentioned problem by storing sequence data into tracks for each tone color in the dual mode and the split mode.

In accordance with the present invention, an instrument for storing musical playing data comprises tone color designation means for designating a plurality of tone colors, musical playing data generation means for generating musical playing data, a plurality of recording tracks for recording the musical playing data, tone color assignment means for assigning each of the tone colors designated by the tone color designation means to each of the recording tracks, and record means for recording the musical playing data into the recording tracks simultaneously with the assigned tone color thereto (DUAL mode). Also the record control means can be a means for recording the musical playing data into the recording track, with the assigned tone color thereto, to which the tone range, for example the left side tone range or the right side tone range of a keyboard, including the tone pitch of the musical playing data is preliminarily assigned (SPLIT mode). In the former DUAL mode, musical playing data (sequence data) is recorded into the recording tracks simultaneously for each tone color, while in the latter SPLIT mode, the sequence data is recorded into one side track corresponding to the tone range that the sequence data is included.

BRIEF DESCRIPTION OF THE DRAWINGS

FIG. 3 shows an example of data format of the sequence tracks configured in a memory.

FIG. 10 shows a table of various registers used in the process.

DETAILED DESCRIPTION OF THE PREFERRED EMBODIMENT

Figure 1:
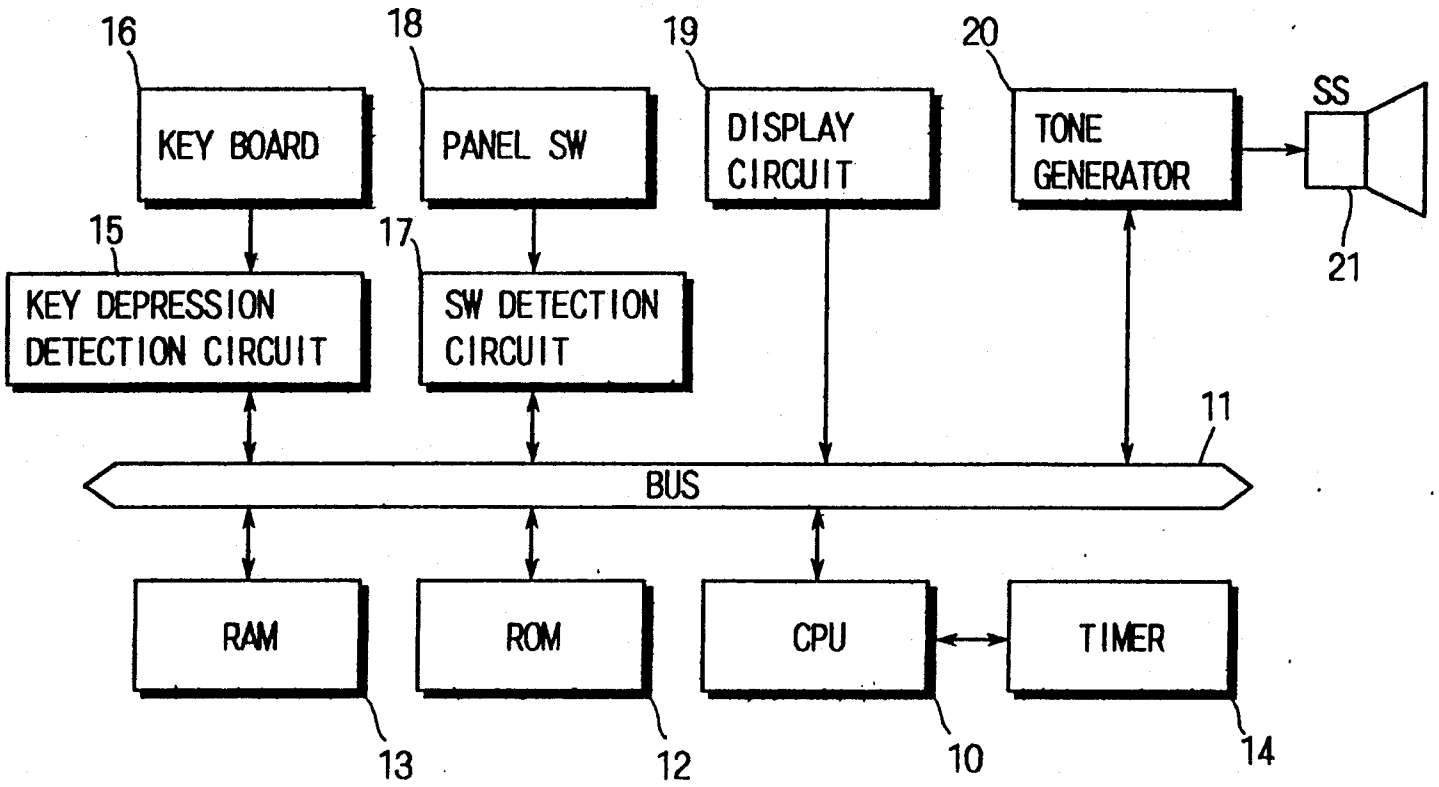
FIG. 1 is a block diagram of an electronic musical instrument having a sequencer which is an embodiment of the present invention.

Referring to the drawings an electronic musical instrument embodying the present invention is shown. The electronic musical instrument is a keyboard type one having a keyboard, and more it has a sequence data (musical playing data) storing area for automatic musical playing back and recording.

FIG. 1 is a block diagram of the electronic musical instrument. The instrument has a CPU for general controlling thereof which is connected to a bus 11 and a timer 14. The timer 14 is a circuit for interrupting the CPU for every constant time in an automatic musical playing mode. The bus 11 is connected to a ROM 12, a RAM 13, a depression key detection circuit 15, a switch detection circuit 17, a display circuit 19, and a tone generator 20. The depression key detection circuit is connected to a keyboard 16, and the switch detection circuit 17 is connected to a panel switch 18. The ROM 12 stores such a program as a flowchart shown later, and the RAM 13 has such a sequence data storing area as shown in FIG. 3. The keyboard 16 has five octave scales. The depression key detection circuit 15 is capable of detecting on/off state and depression force of each key. The keyboard 16 is used for both ordinal musical playing and tone pitch (key code) inputting in a musical playing data record mode. The panel switch 18 and the display circuit 19 is arranged as shown in FIG. 2.

Figure 2:
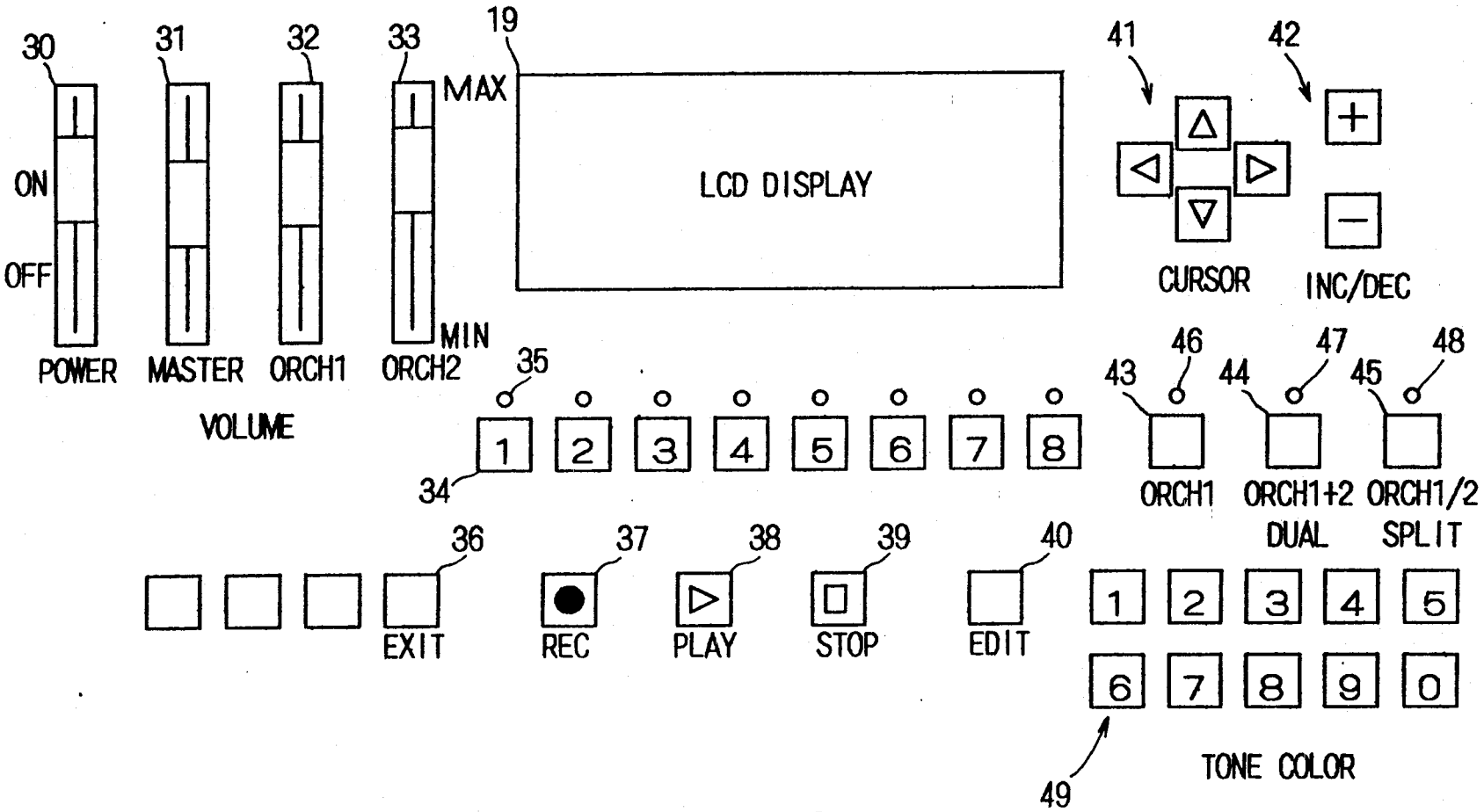
FIG. 2 illustrates a operation panel of the electronic musical instrument.

Referring to FIG. 2, the operation panel is provided with shown switches.

A power switch 30 is a switch for putting a power source of this instrument on or off. Numerals 31 to 33 point volume type operators, namely, the numeral 31 points a master volume slider, and the numerals 32 and 33 point volume sliders for adjusting an output level and a recording level of a tone color 1 (ORCH 1) and a tone color 2 (ORCH 2), respectively. The track switch 34 is a switch for designating a track to automatically play and record musical playing data. The instrument has eight sequence tracks 1 to 8. Corresponding to these tracks LEDs 35 are provided, each of which is lit when the corresponding track is designated. The EXIT switch 36 is a switch for turning a sequence mode off. The sequence mode is a mode in which sequence data is recorded or played back. The switches 37 to 40 are used in the sequence mode; the numeral 37 is a record switch, the numeral 38 is a play switch, the numeral 39 is a stop switch, and the numeral 40 is a editing switch for editing musical playing data. When the track designation switch 34 is depressed and the editing switch 40 is depressed, the musical playing data stored in the designated track is displayed in the display device 19. A cursor key 41 is a key for moving a cursor in the display device 19. An increasing and decreasing key (+/− key) 42 is used for increasing and decreasing displayed value designated by the cursor key 41. Tone generation mode designation switches 43 to 45 have LEDs 46 to 48 are used for designating a tone generation mode out of the normal mode, the dual mode and the split mode. The numeral 49 points a tone color selection switch. The tone generation mode designations witch 45 to set the split mode serves for selecting two registers ORCH1 and ORCH2 each of which stores the tone color designated by the tone color selection switch 49, and for assigning a left side range of the keyboard 16 to the ORCH1 and a right side range thereof to the ORCH2. That is, when the ORCH1 or the ORCH2 is assigned to the designated track by depressing the tone generation mode designation switch 45, the left side range and the right side range are automatically assigned to the designated tracks respectively.

FIG. 3 shows an example of data format of the sequence tracks configured in the RAM 13. The sequence tracks has eight tracks in each of which musical playing data is independently stored. When the sequence data in two or more tracks is simultaneously recorded or played back, the clock for the tracks to read the data is counted up synchronously. The head address area of each track is allocated for storing a tone color with which the musical tone data (sequence data) of the track is generated, ad the end address data of the sequence data is end data. Note data comprises timing data for deciding generating timing, a note number for deciding a tone pitch, velocity data for deciding tone generating force and gate time data for deciding tone generating length. Volume data following the tone color data comprises timing data and tone volume value data.

FIGS. 4 to 9 are flowcharts showing a process of the musical instrument. FIG. 10 illustrates a portion of a register configured in the RAM 13.

Figure 4:
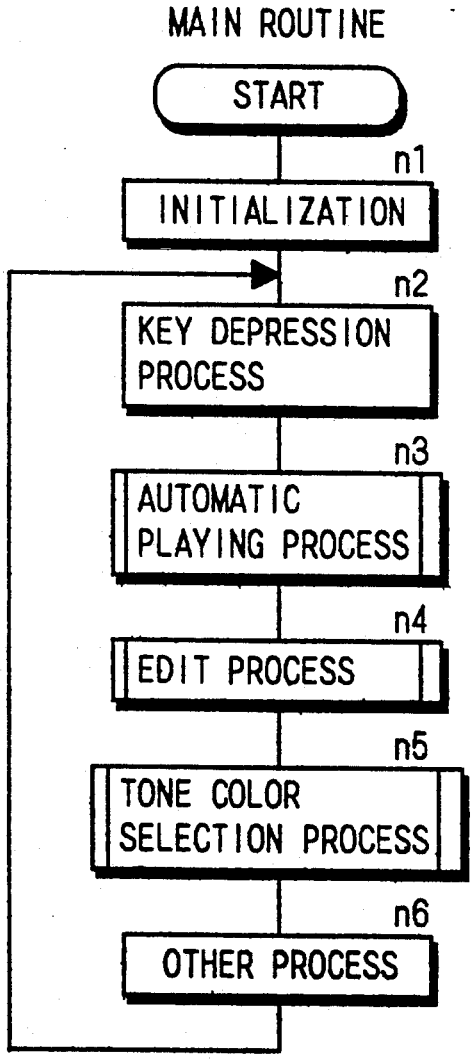
FIGS. 4 to 9 is a flow chart showing a process of the electronic musical instrument.

FIG. 4 is a main flowchart. When the power source of the instrument is activated by the power switch 30, an initializing process to initial set to the various registers in the RAM 13 is performed (n1), resulting in playable condition. After that, a depression process (n2), an automatic playing process (n3), an editing process (n4), a tone color selection process (n5), and the other processes (n6) are performed repeatedly. The depression process (n2) is a tone generation and a tone release process based on the operation of the keyboard 16 in the normal playing mode. The automatic playing process (n3) is a process in which musical playing data is recorded into a sequence track and the thus recorded musical playing data is played back to sound musical tones. The editing process (n4) is a process in which the musical playing data in a sequence track is edited. The tone color selection process (n5) is a tone color selecting process by use of the tone color selection switch 49. The other processes include a process to control a tone volume based on the operation of the volume sliders 32 and 33.

Figure 5:
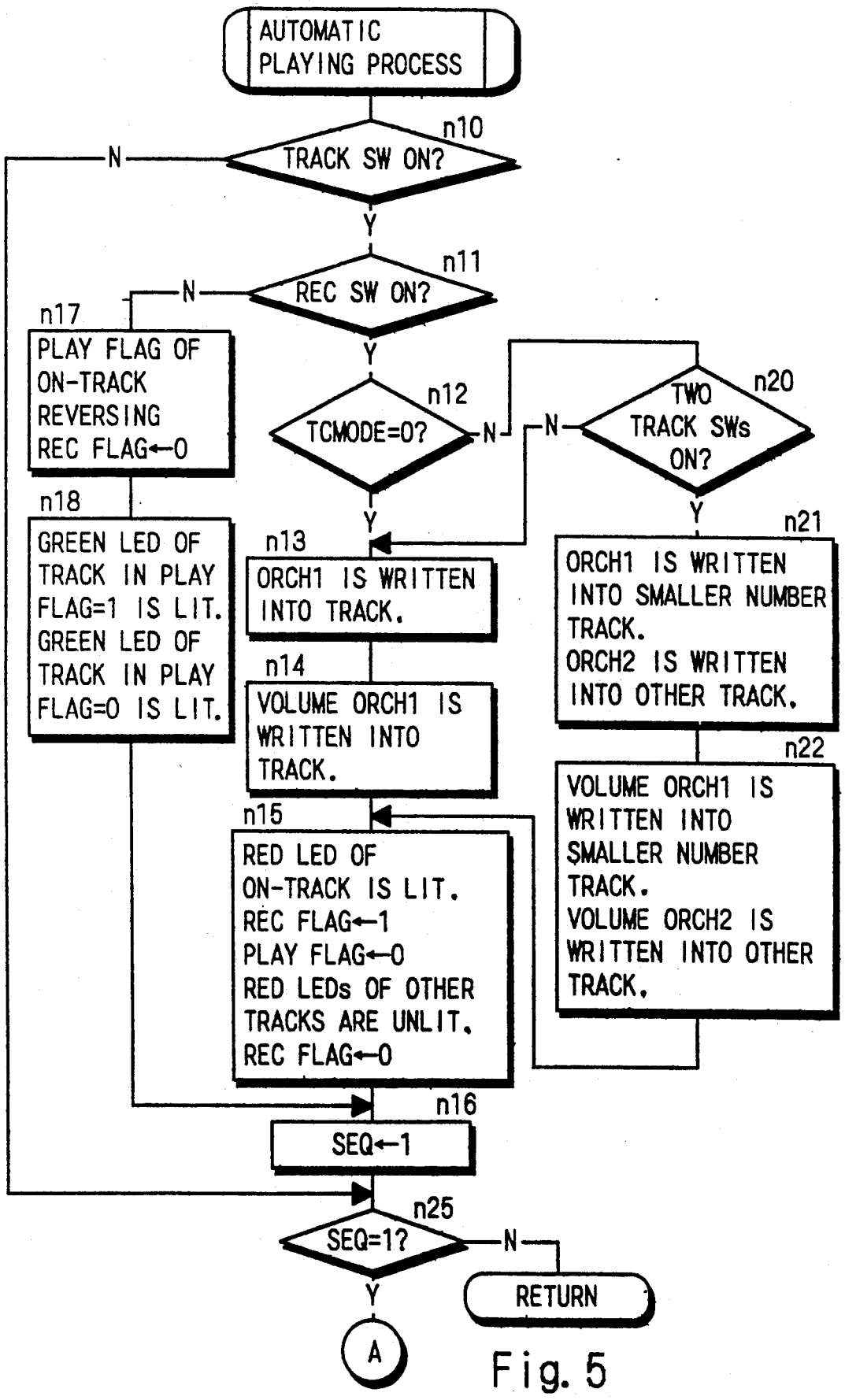
Figure 6:
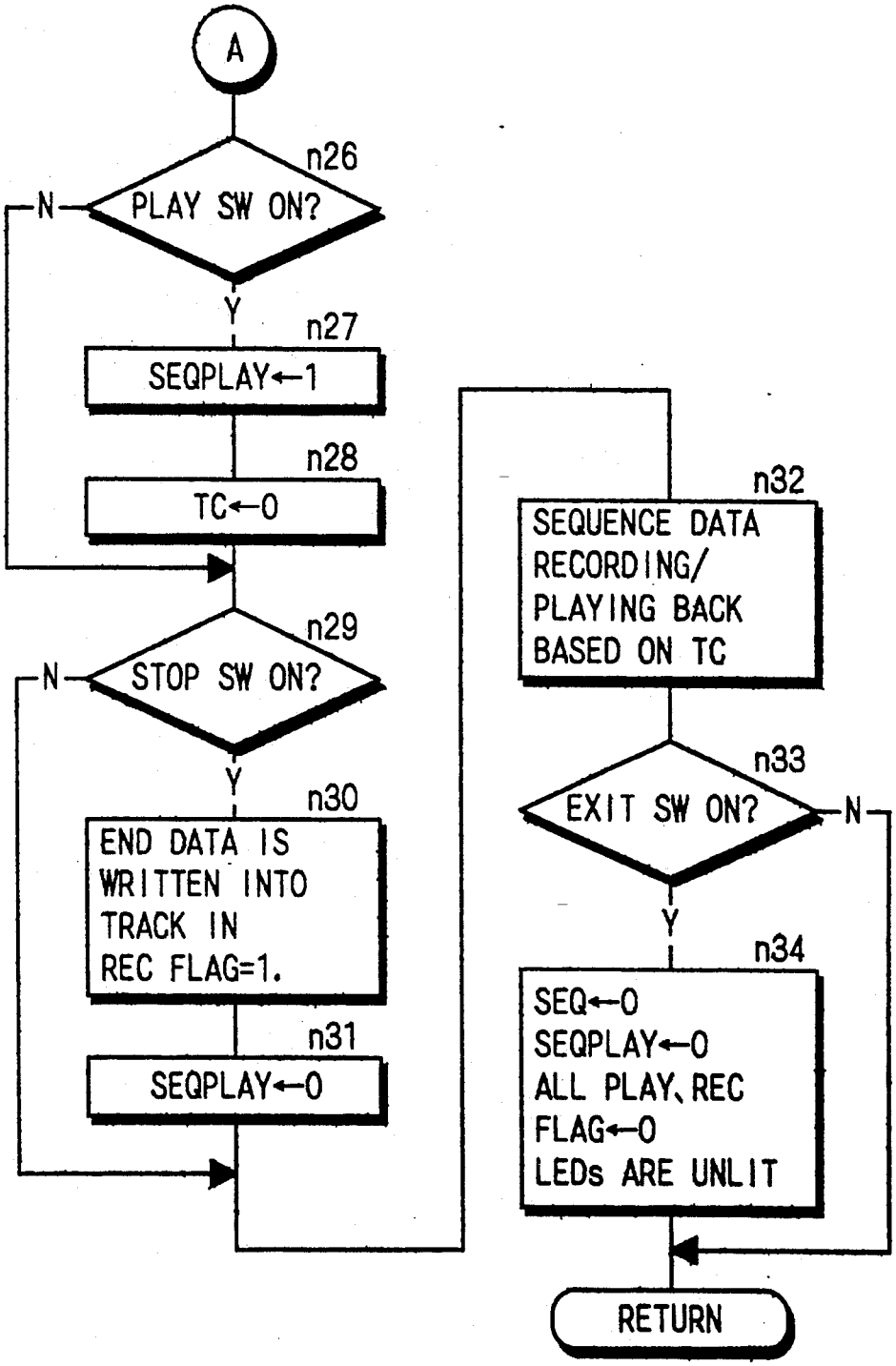

FIGS. 5 and 6 are flowchart showing the automatic playing process. In this process, on/off of the track switch 34, the record switch 37, the play switch 38, the stop switch 39 and the EXIT switch 36 are judged (n10, n11, n20, n26, n29, n33).

Generally, in the sequence mode, the first operation is a track designation key operation to designate a track by use of the track switch 34. If the playing back mode is required, only the track switch 34 is operated, while if the record mode is required, the track switch 34 and the record switch 37 are operated simultaneously. The playback or the record corresponding to the designated track is performed when the play switch 38 is depressed. If there are the playback mode track and the record mode track, both processes of playing back and recording are performed when the play switch 38 is depressed. When the stop switch 39 is depressed during the sequence mode processing, the playback process or the record process is stopped, but the sequence process is kept so that the playback or the record process is performed again as the play switch is re-depressed. If the stop switch 39 is depressed to stop the process and the EXIT switch 36 is depressed, the track designation is invalidated and the mode is changed from the sequence mode to the normal mode.

In the above mentioned key-sequence, if two tracks for record are designated, musical playing data (sequence data) is recorded in the dual mode or the split mode.

In the step n10, when the track switch 34 is depressed, whether the record switch 37 is simultaneously depressed or not is judged (n11). If "yes" is returned, the instrument is in the record mode, otherwise if "no" is returned, the instrument is in the playback mode. If "no" is returned at the step n11, i.e. the record switch is not depressed, a PLAY flag for the designated track is reversed and a REC flag for the designated track is reset (n17). Next, the LED for the PLAY flag=1 is turned on; the LED for the PLAY flag=0 is turned off (n18). After that the process goes to the step n16. While at the step n11, if the record switch 37 is depressed simultaneously with the track switch and a tone generation mode flag TCMODE is zero, the instrument is in the normal mode. In the normal mode, the tone color designated by a register ORCH1 is written into the designated track (n13), and the volume value of the volume slider 32 (ORCH1) is written into the designated track (n14). A red LED for the designated track is turned on; the REC flag for the same track is set; the PLAY flag for the same track is reset. Also, the red LEDs for the other tracks are turned off; the REC flags for the tracks are reset (n15). At the step n12, if the register TCMODE doesn't represent zero and two track switches are depressed simultaneously (n20), the tone color of the register ORCH1 is written into the smaller number track and the tone color of the register ORCH2 is written into the larger number track (n21). Furthermore, the values of the volume sliders 32 (ORCH1) and 33 (ORCH2) are written into the both tracks (n22). After that the process goes to the step n15. While, if in spite of not zero of the register TCMODE, only one track switch is depressed, the process goes from n20 to n12 to write the designated tone color by the register ORCH1 into the designated track (n13). At the step n16, the sequence mode flag SEQ is set (n16), and the sequence mode flag SEQ is judged at n25. If the flag has not been set, the process returns.

When the sequence mode flag SEQ is in a set condition, whether any of the play switch 38, the stop switch 39 and the EXIT switch is turned on or not is judged (n26, n29, n33). If the play switch 38 is turned on, the sequence play flag SEQPLAY is set (n27), and a tempo clock register TC is cleared (n28). If the stop switch 39 is turned on, the end data is written into the track for which the REC flag is set to "1" (n30), and the sequence play flag SEQPLAY is reset (n31). If the EXIT switch 36 is turned on, both flags of SEQ and AEQPLAY are reset, the PLAY and the REC flags for all tracks being reset and the LEDs for the tracks being turned off (n34).

In the above described process, the playing data is written into the track for which the REC flag is set to "1" based on the tempo clock TC, simultaneously, the playing data being read from the track for which the PLAY flag is set of "1" to output the data to the tone generator (n32).

The following description relates to simultaneous record mode for two tracks, i.e. the dual mode or the split mode.

In the dual mode, the generated playing data is written into the two designated tracks at the same time, while in the split mode, the depression position is judged whether the position locates at the right side or the left side compared with the predetermined split point, thereby to write the playing data into the assigned track. The record process starts effectively at the timing the play switch 38 is depressed and thereby the tempo clock TC is reset to start counting from the beginning.

Figure 7:
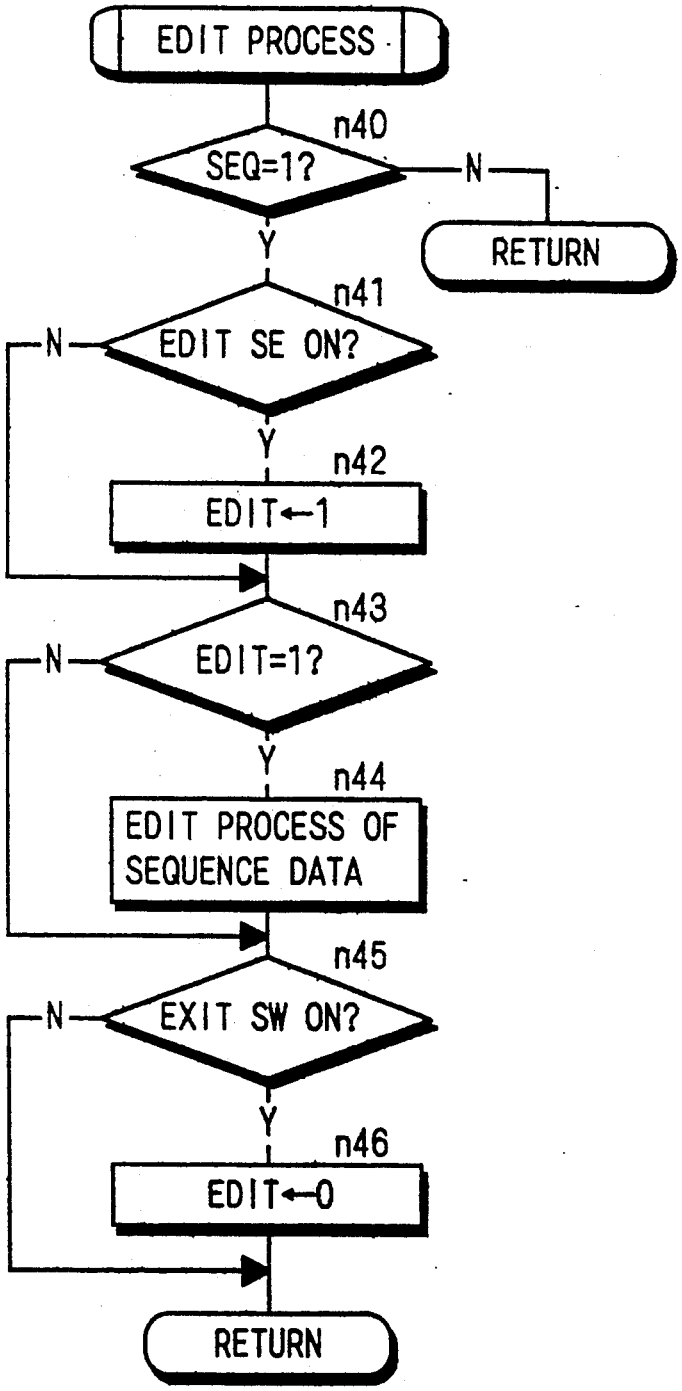

FIG. 7 is a flow chart showing the editing process.

This process is effective only in the sequence mode, so that the sequence mode flag SEQ is judged first (n40). If the flag has not been set, the process returns. With the set of the flag SEQ, if the edit switch 40 is turned on, an edit mode flag EDIT is set (n41, n42). Next, the flag EDIT is judged (n43). If the flag EDIT equals "1", an editing process to the sequence data (musical playing data) is carried out (n44). The editing process is a process in which modifying, deleting or copying of the sequence data is done for each track. The editing process is carried out by, for example, using the cursor key 41 to point at a value in the LCD 19 and using the +/− key 42 to increase or decrease the displayed value pointed out by the cursor key 42. When the EXIT switch 36 is depressed, the edit mode flag EDIT is reset and the process returns (n46).

Figure 8:
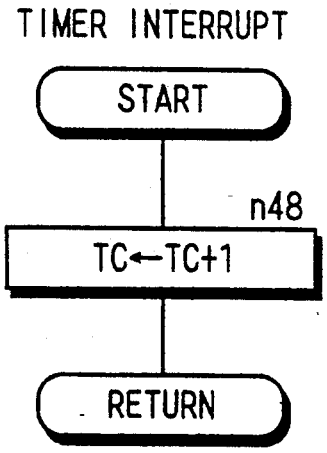

FIG. 8 shows an interrupt process which is carried out by the interruption from the timer 14 for every constant time. The tempo clock register TC is increased in this process (n48) and the process returns.

Figure 9:
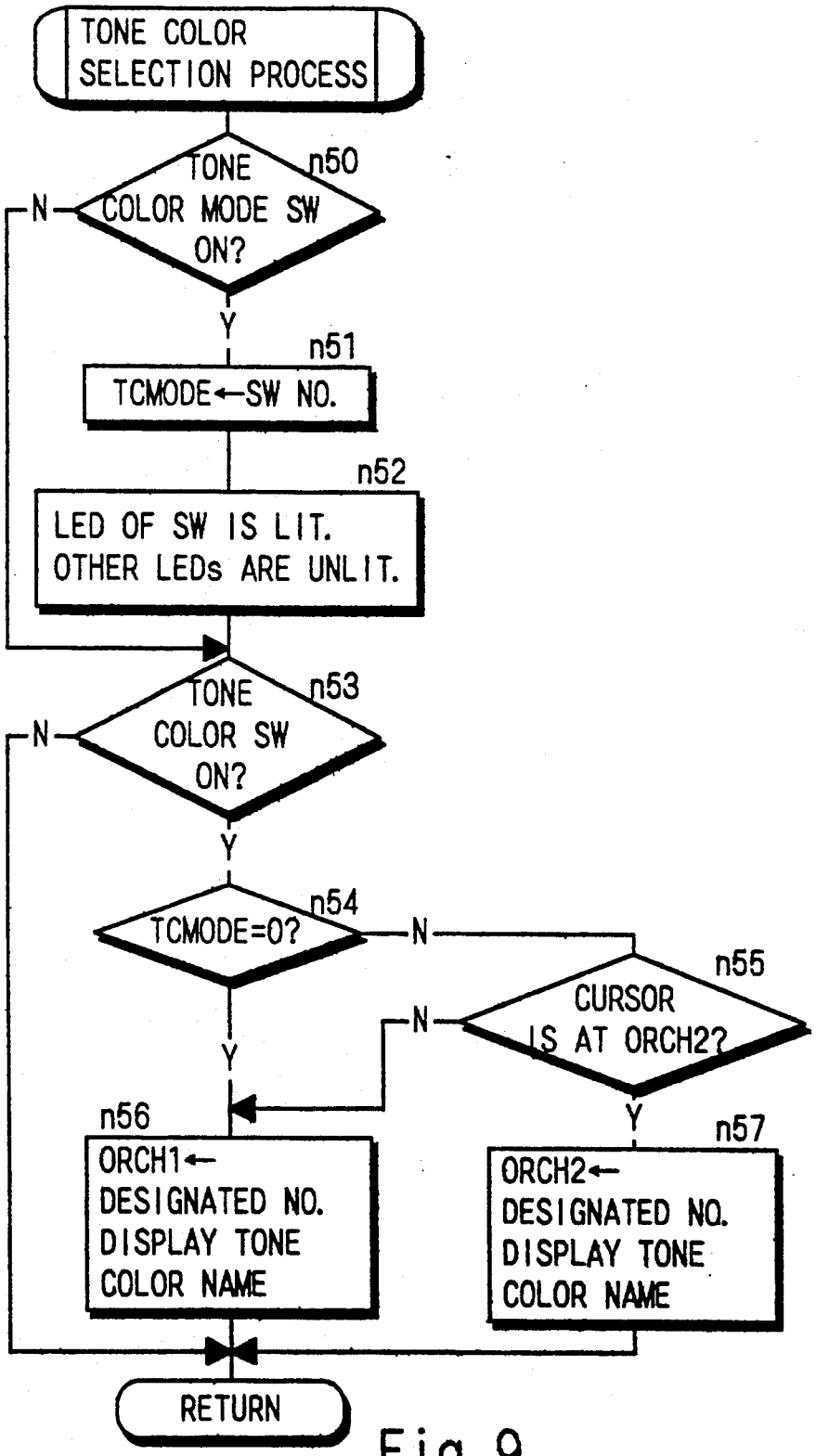

FIG. 9 is a flow chart showing the tone color selecting process.

At the step n50 and n53, whether any of the tone generation mode switches 43 to 45 or the tone color switch 49 is depressed or not is judged. If the tone generation mode switch's on is detected, the on-switch's number (normal mode switch 43=0, dual mode switch 44=1, split mode switch 45=2) is set into the tone generation mode flag TCMODE (n51), the corresponding LED being lit (n52). If the tone color switch's on is detected, the tone generation mode flag TCMODE is judged (n54). If the flag TCMODE=0, the instrument is in the normal mode so that the tone color's number designated by the tone color switch 49 is set into the register ORCH1 (n56), while if the flag TCMODE=1 or 2, the instrument is in the dual mode or the split mode so that a tone color's number in the register (ORCH1 or ORCH2) pointed out by the cursor in the LCD 19 is rewritten with the designated tone color by the tone color switch 49 (n55 to n57).

As described above, it is possible that the sequence data with two tone colors is recorded into a different track for each tone color. Therefore, the editing of the sequence data can be performed for each tone color.

The dual mode and the split mode can be applied to three or more tone colors as well as the two tone colors. Furthermore, in place of the fact that the tone color of the ORCH1 is assigned to the smaller numbered track and the tone color of the ORCH2 is assigned to the larger numbered track at the step n21, it is available that the tone color of the ORCH1 is assigned to the first designated track and the tone color of the ORCH2 is assigned to the second designated track.

What is claimed is:

1. An instrument for storing musical playing data comprising:
   - tone color designation means for designating a plurality of tone colors;
   - musical playing data generation means for generating musical playing data;
   - a plurality of recording tracks for recording the musical playing data;
   - tone color assignment means for assigning each of the tone colors designated by the tone color designation means to a different one of the plurality of recording tracks; and
   - musical playing data recording means for recording the musical playing data in parallel into each of the recording tracks, to which a tone color has been assigned so that the same musical playing data will be recorded in plural tracks.

2. An instrument for storing musical playing data according to claim 1, wherein said musical playing data generation means has a plurality of keys.

3. An instrument for storing musical playing data according to claim 1, further comprising track selecting means for selecting said plurality of recording tracks.

4. An instrument for storing musical playing data according to claim 1 further comprising tone volume designation means for designating the volume of each tone color designated by tone color designation means and tone volume assignment means for assigning each volume designated by the volume designation means.

5. An instrument for storing musical playing data according to claim 1, the tone color designation means designates the priority of each of the tone colors wherein and the tone color assignment means assigns each of the tone colors to each of the recording tracks in accordance with each of the priority.

6. An instrument for storing musical playing data according to claim 5, further comprising track selecting means for selecting the recording tracks in a plurality of the tracks, when the number of the designated tracks are less than the number of the designated tone colors, wherein said recording means records tone color data in order of priority into the recording tracks.

7. An instrument as in claim 1 wherein the musical playing data recording means includes means for recording data indicative of the tone color of each assigned track into the respective tracks.

8. An instrument for recording musical playing data comprising:
   - tone color designation means for designating a plurality of tone colors;
   - musical playing data generation means for generating musical playing data including data representing notes in different tone ranges;
   - a plurality of of recording tracks for recording the musical playing data;

tone color assignment means for assigning each of the tone colors designated by the tone color designation means to a different one of the recording tracks; and musical playing data recording means for recording playing data of different tone ranges into different recording tracks corresponding to each of the tone ranges.

9. An instrument for storing musical playing data according to claim 8, wherein said musical playing data generation means includes a keyboard, having a plurality of keys, arranged so as to split it into a left side tone range and a right side tone range.

10. An instrument for storing musical playing data according to claim 8, further comprising tone volume designation means for designating the volume of each tone color designated by tone color designation means and tone volume assignment means for assigning each volume designated by the tone volume designation means.

11. An instrument for storing musical playing data according to claim 8, wherein the tone color designation means designates the priority of each of the tone colors and the tone color assignment means assigns each of the tone colors to each of the recording tracks in accordance with each designated of the priority.

12. An instrument for storing musical playing data according to claim 11, further comprising track selecting means for selecting the recording tracks in a plurality of the tracks, when the number of the selected tracks are less than the number of the designated tone colors, and wherein the record means records tone color data in order of priority into the recording tracks.

13. An instrument as in claim 8 wherein the musical playing data recording means includes means for recording data indicative of the tone color of each assigned track into the respective tracks.

* * * * *